US006473911B2

(12) United States Patent
Weiss

(10) Patent No.: US 6,473,911 B2
(45) Date of Patent: Nov. 5, 2002

(54) DISPOSABLE, COMPACT, PORTABLE TODDLER-SIZE TOILET SEAT PROTECTOR

(76) Inventor: David G. Weiss, 2125 Crosscreek Ave., Simi Valley, CA (US) 93063

( * ) Notice: Subject to any disclaimer, the term of this patent is extended or adjusted under 35 U.S.C. 154(b) by 0 days.

(21) Appl. No.: 09/997,841

(22) Filed: Nov. 29, 2001

(65) Prior Publication Data

US 2002/0078495 A1 Jun. 27, 2002

Related U.S. Application Data

(60) Provisional application No. 60/250,205, filed on Nov. 29, 2000.

(51) Int. Cl.[7] ..... A47K 13/06
(52) U.S. Cl. ..... 4/239
(58) Field of Search ..... 4/235, 237, 239

(56) References Cited

U.S. PATENT DOCUMENTS

| | | | |
|---|---|---|---|
| 1,377,541 | A | 5/1921 | Young |
| 1,522,699 | A | 1/1925 | Reid |
| 1,582,527 | A | 4/1926 | Marks |
| 1,635,072 | A | 7/1927 | De Luna |
| 1,673,622 | A | 6/1928 | Engalitcheff |
| 1,710,620 | A | 4/1929 | Hawkins |
| 1,733,080 | A | 10/1929 | Hamilton |
| 2,260,404 | A | 10/1941 | Richardi |
| 2,312,589 | A | 3/1943 | Reeves |
| 2,548,238 | A | 4/1951 | Potts et al. |
| 2,716,244 | A | 8/1955 | Wendel |
| 2,742,650 | A | 4/1956 | Mohun et al. |
| 2,825,070 | A | 3/1958 | Alexander et al. |
| 3,316,560 | A | 5/1967 | Montaldo |
| 5,005,223 | A | 4/1991 | Greenwood |

*Primary Examiner*—Charles E. Phillips
(74) *Attorney, Agent, or Firm*—Sidley Austin Brown & Wood LLP

(57) ABSTRACT

A compact, portable, and disposable toilet seat cover is described which provides protection from a potentially unsanitary toilet seat by allowing the user to avoid contact with a toilet seat. Preferably the toilet seat cover is sturdy, stable, and easily assembled such that it can be easily transported and conveniently used in a variety of situations. More preferably, the toilet seat cover is specifically adapted for use by a child or small adult.

15 Claims, 4 Drawing Sheets

DISPOSABLE, COMPACT, PORTABLE TODDLER-SIZE TOILET SEAT PROTECTOR

This application claims the priority of the filing date of U.S. Provisional Application Serial No. 60/250,205, filed Nov. 29, 2000.

FIELD OF THE INVENTION

This invention generally relates to a child-size toilet seat cover. More particularly, a toilet seat cover that provides a sturdy, protective, barrier between a child and a toilet seat. The toilet seat cover's distinctive properties include portability, compactness and the disposability of the product.

BACKGROUND OF THE INVENTION

In today's world of heightened health concerns, the need for protection from a potentially unsanitary toilet and/or toilet seat is of public concern. The typical protection offered is tissue-type paper, cut in the shape of a standard-sized toilet seat. However, this protection is often inadequate. It is especially inadequate for a child. Moreover, since standard-sized toilet seats in most public places and homes contain too large of an opening for most children, children often need to hold themselves up by placing their hands on the toilet seat, thereby increasing their contact with potentially unsanitary toilet seats.

While there are some toilet seat protection products commercially available, most often they are either portable or disposable, but not both. Moreover, some products are designed to be portable and disposable, but are not compact enough, in size, flatness, or both, to carry in the usual-size baby bag or nap-sack. Because of the lack of convenience, whether due to a lack of portability, disposability, or compactness, often these toilet seats or toilet seat covers are not used. Additionally, some do not readily sit atop a standard-sized toilet seat but instead must be attached to the toilet seat somehow. In that case, the toilet seat is typically only used in one's own home.

The prior art describes some toilet seat covers, including some designed for children. However, none sufficiently describe a toilet seat cover that solves all of the problems identified above. For instance, toilet seats, even some intended for a small child are described, but they require some way of attaching the seat to a standard toilet seat in order to provide stability (e.g., U.S. Pat. No. 2,548, 238). Others do not provide any protection from the back portion of a toilet (e.g., U. S. Pat. No. 2,825,070) or do not cover the entire top portion of a toilet seat, but rather follow the exact shape (i.e., U or C shaped) of a standard toilet seat (e.g., U.S. Pat. No. 5,005,223). Still others do not provide protection from the inside or outside of the front portion of a toilet bowl itself or do not provide a seat cover with a larger seating area that can be compact enough such that it is easily carried in a nap-sack, standard baby-bag, or the like (e.g., U.S. Pat. Nos. 2,825,070 and 5,005,223).

Consequently, there is a need to provide a sturdy, stable and disposable toilet seat cover that is compact and portable so that it can be easily transported from place to place in a variety of situations in the usual-size baby bag, nap-sack, stroller, or car for use at restaurants, amusement parks, and other public and private places where additional protection from a potentially unsanitary toilet and/or toilet seat is desired. Moreover, there is a further need for a toilet seat cover as described which is specifically adapted for use by a child or small adult.

SUMMARY OF THE INVENTION

A portable, disposable toilet seat cover is provided which contains a seat portion, an up-flap along the rear of the seat which extends upward from the seat, a down-flap along the front of the seat which extends downward from the seat, side flaps along the rear sides of the seat extending upward from the seat, and side flaps on the front sides of the that seat extend downward from the seat.

It is an object of this invention to provide a toilet seat cover that has a smaller than standard toilet bowl opening in the seat such that a child or small adult has a larger seating area. Moreover, the toilet seat cover has flaps on either side and in the front portion of the seat cover which can be set, sturdily, on a standard toilet seat with minimal movement in all directions of the horizontal plane with respect to the toilet seat. Thus, the present invention provides a disposable toilet seat cover that is compact, portable and easy to assemble that can provide sturdy and stable seating.

DETAILED DESCRIPTION OF THE PREFERRED EMBODIMENTS

Figure 1:
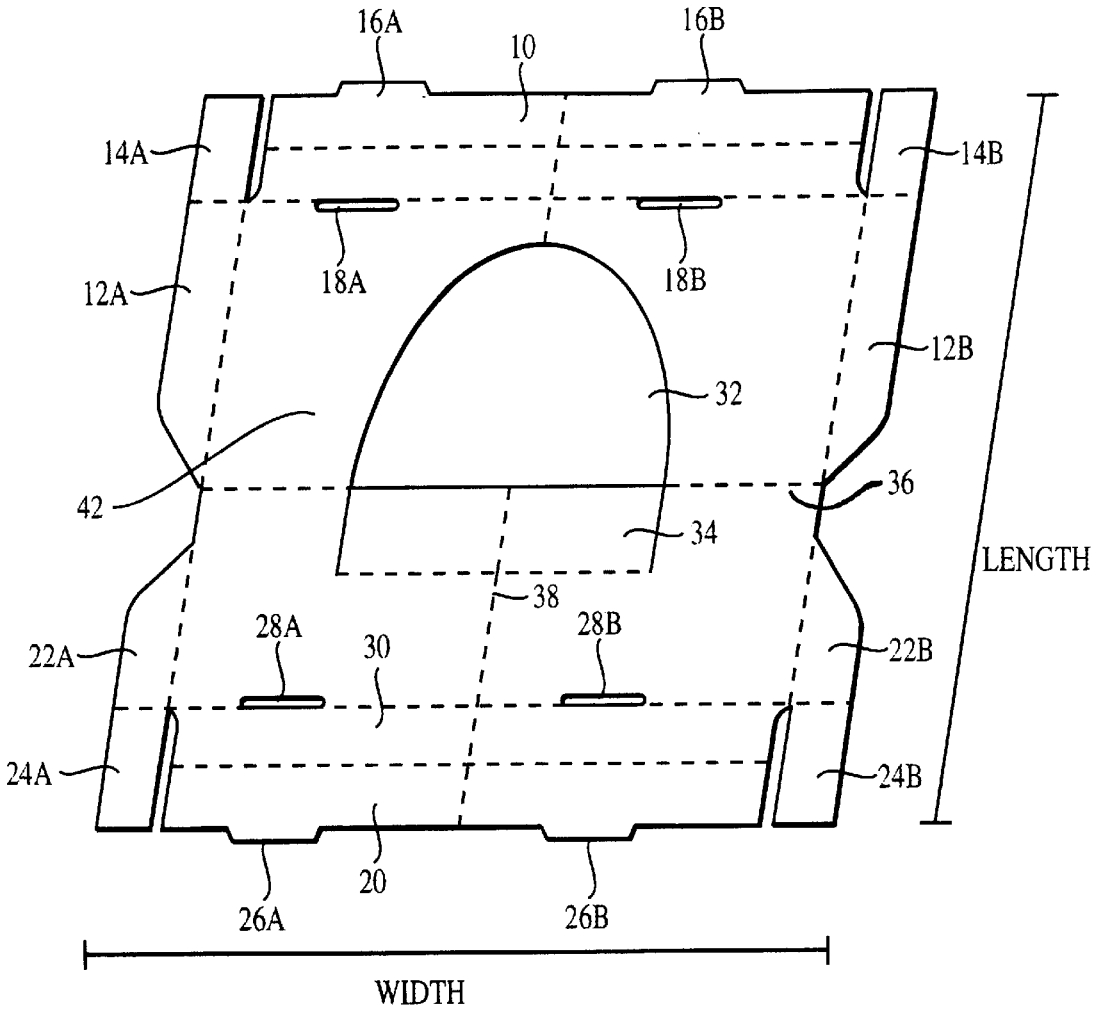
FIG. 1 is a top view of a preferred embodiment of the inventive toilet seat cover unassembled with dashed lines representing the scores.

Referring now more particularly to the drawings, in which like reference numerals are used to indicate like parts in the several views, in the example of FIG. 1 it is shown that the unassembled toilet seat cover has scores, or fold guidelines, which define the areas which can be folded in assembling the toilet seat cover. The scores would preferably be deep enough to allow for folding with minimal effort but should not be so deep as to cut the scored areas from each other. The scores along the center of the toilet seat cover, which run the horizontally 36 and vertically 38 across the length of the toilet seat cover, delineating, generally, four quadrants to the toilet seat cover. The scores 36 and 38 are fold guidelines for folding the toilet seat cover one time horizontally and one time vertically such that it achieves a minimum unassembled size that is conveniently compact as in the example shown in FIG. 4.

The scores on the toilet seat cover allow the user to simply and quickly assemble the toilet seat cover for use with minimal effort. The seat portion 42 has a top surface and a bottom surface. The toilet seat cover may be assembled by forming the up-flap 10 and the down-flap 20 in the following manner. The up-flap 10 is assembled, for example, by folding sides 12A and 12B in an upward direction, to a position roughly perpendicular to the top surface of the seat portion and folding side flaps 14A and 14B inwardly toward each other. The up-flap 10 is folded upward and over side flaps 14A and 14B to push tabs 16A and 16B downwardly toward the top surface of the seat portion into slots 18A and 18B in the seat portion, locking tabs 16A and 16B into place in slots 18A and 18B respectively.

The down-flap 20 is assembled, for example, by folding the sides 22A and 22B in a downward direction, to a position roughly perpendicular to the bottom surface of the seat portion and folding side flaps 24A and 24B inwardly toward each other. The down-flap 20 is folded downward and over side flaps 24A and 24B to push tabs 26A and 26B upwardly toward the bottom surface of the seat portion into slots 28A and 28B in the seat portion, locking tabs 26A and 26B into place in slots 28A and 28B respectively.

These opposing folds created by the assembled up-flap 10 and the down-flap 20 provide a rigid seating area. The assembled down-flap 20 is designed to hang over the forward outside edge of a standard-size toilet and/or toilet seat where the outside portion 30 of the down-flap 20 would face away from the toilet as, for example, shown in FIG. 3. This position provides prevents a user's legs from touching the front part of the toilet and/or toilet seat. The assembled down-flap 20 and the assembled sides 22A and 22B create a support and guiding structure such that when placed upon a standard toilet seat the toilet seat is guided into place and is limited in lateral movement, providing stability when used.

Figure 2:
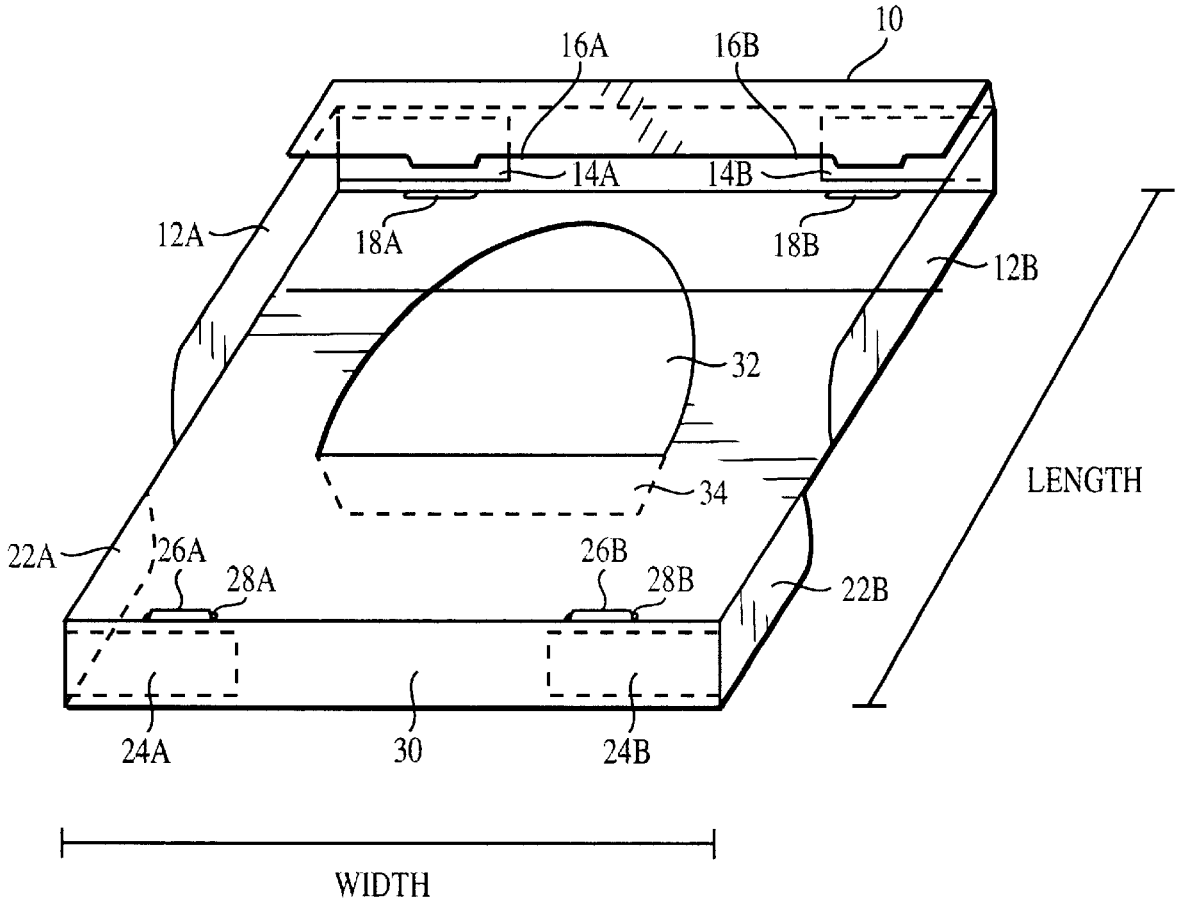
FIG. 2 is a top view of a preferred embodiment of the inventive toilet seat cover with the "up-flap" partially assembled and the "down-flap" completely assembled.
Figure 3:
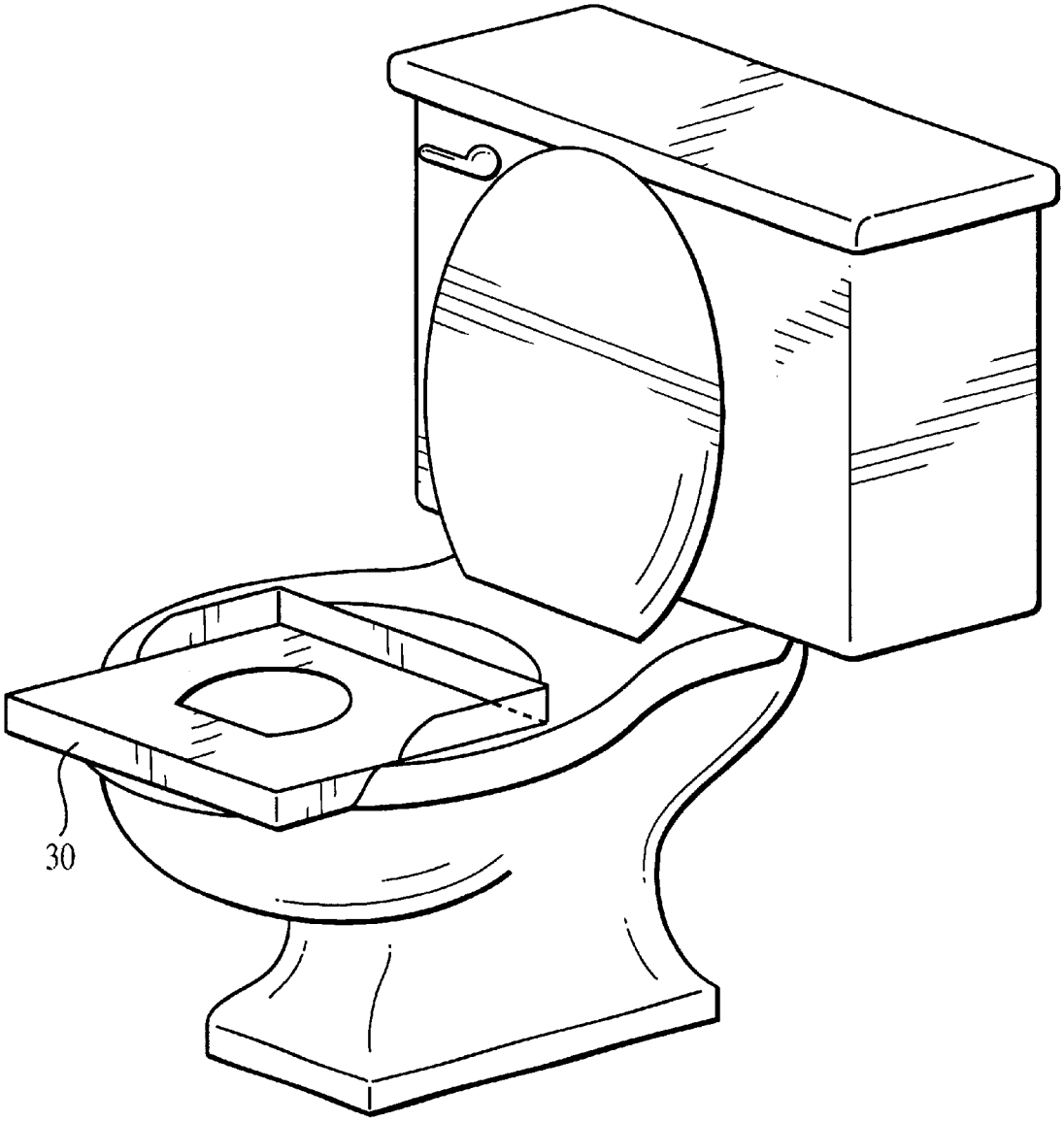
FIG. 3 is a perspective view of a preferred embodiment of the inventive toilet seat cover assembled and set atop a toilet seat.

In a preferred embodiment, as depicted in the examples of FIG. 1, 2, and 3, the seat portion 42 can be pre-cut to create an opening 32 that has a smaller diameter than that of a standard toilet seat and/or toilet bowl opening. This pre-cut opening 32 can, for example, create a larger seating area such that a user would have a larger seat surface area as compared to a standard toilet seat. This embodiment is most preferred when the user is a child or small adult.

In a more preferred embodiment, as depicted in the examples of FIGS. 1 and 2, the pre-cut opening 32 in the seat portion 42 would contain a scored flap 34 which can, for example, be folded downward into the toilet bowl for protection from the inside of the toilet bowl. Additionally, scored flap 34 can be folded in an upwardly position for deflection or to minimize splashing.

The present invention can be made of a lightweight, foldable, and sturdy material. For example, in a preferred embodiment, the inventive toilet seat cover can be made of a material such as corrugated cardboard or the like. In a more preferred embodiment, the toilet seat cover can be made of an inexpensive material such that it can be inexpensive to dispose of and replace by a consumer.

Figure 4:
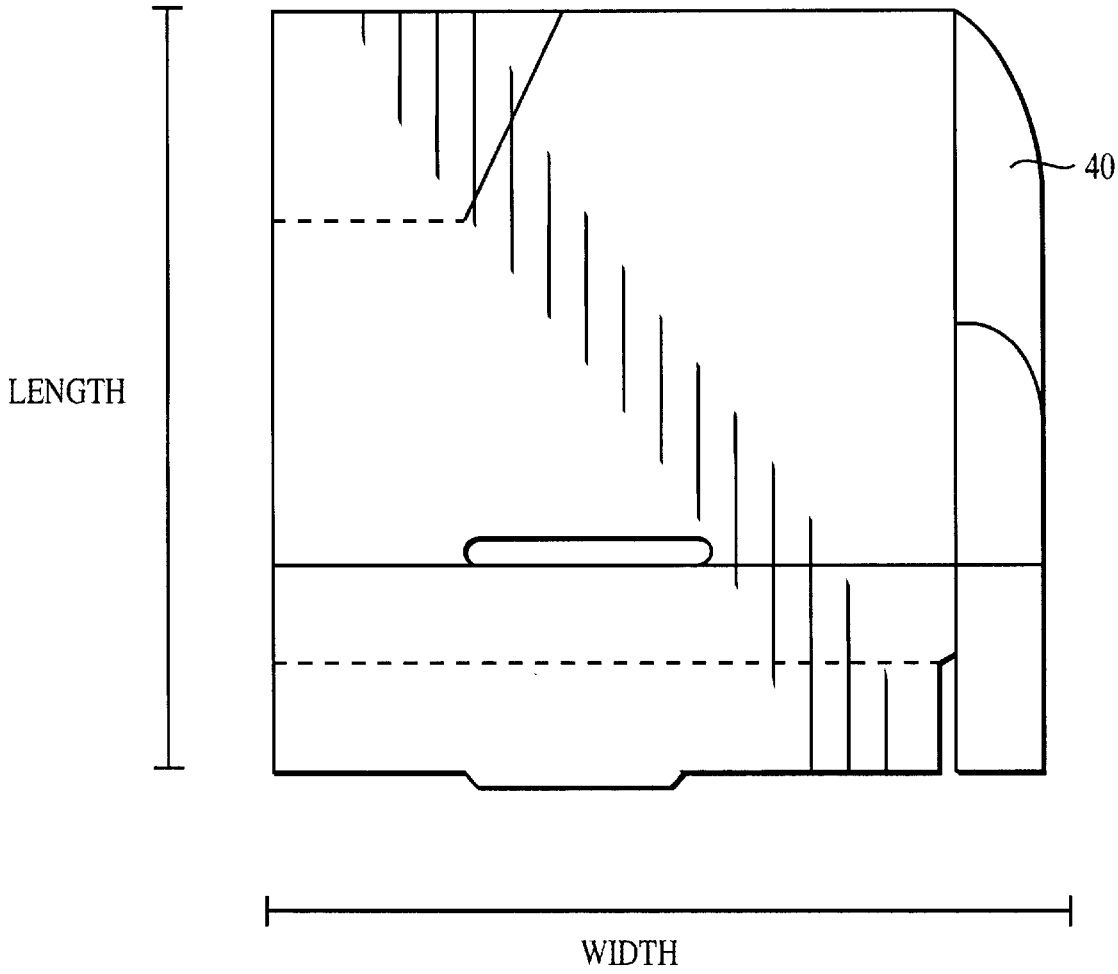
FIG. 4 is a top view the front right quadrant of a preferred embodiment of the inventive toilet seat cover unassembled and folded.

A preferred embodiment of the present invention can be, for example, about eleven to fifteen inches in wide about thirteen to eighteen inches long when laid out flat, about nine to thirteen inches wide by about nine to about thirteen inches long when assembled, and about four inches to about eight inches wide by about five inches to about nine inches long when folded along scores 36 and 38 as shown, for example, in FIG. 4.

In a more preferred embodiment, the dimensions 40 of the present invention when unassembled and laid out flat can, for example, be about thirteen inches wide by about fifteen and one-half inches long, when assembled can, for example, be about eleven inches wide by about eleven inches long, and when folded along scores 36 and 38 as shown, for example in FIG. 4, can reduce the dimensions 40 to about six and one-half inches wide by about seven and three-quarters inches long.

While there have been described what are believed to be the preferred embodiments of the present invention, those skilled in the art will recognize that other and further changes and modifications can be made thereto without departing from the spirit of the invention, and it is intended to claim all such changes and modifications as fall within the true scope of the invention.

What is claimed is:

1. A portable, disposable toilet seat cover comprising (a) a seat portion 42 having a top surface and a bottom surface, (b) an up-flap 10 along the rear of the seat which extends upwardly from the seat portion, (c) a down-flap 20 along the front of the seat which extends downwardly from the seat portion, (d) sides 12A and 12B on the rear sides of the seat extending upwardly from the seat portion, and (e) sides 22A and 22B on the front sides of the seat extending downwardly from the seat portion.

2. A toilet seat cover as in claim 1, wherein the seat portion 42 comprises a pre-cut opening 32.

3. A toilet seat cover as in claim 2, where in the seat portion 42 comprises a scored flap 34.

4. A toilet seat cover as in claim 1, wherein the up-flap 10 is formed by (a) folding the sides 12A and 12B upwardly from the seat portion 42, (b) folding side flaps 14A and 14B inwardly, (c) folding the up-flap 10 up and over side flaps 14A and 14B, and (d) pushing tabs 16A and 16B downwardly into slots 18A and 18B.

5. A toilet seat cover as in claim 1, wherein the down-flap 20 is assembled by (a) folding the sides 22A and 22B downwardly from the seat portion 42, (b) folding side flaps 24A and 24B inwardly, (c) folding the down-flap 20 down and over side flaps 24A and 24B, and (d) pushing tabs 26A and 26B upwardly into slots 28A and 28B.

6. A toilet seat cover as in claim 1, wherein when placed upon a toilet seat the down-flap 20 and sides 22A and 22B hang over the forward portion of a standard-size toilet.

7. A toilet seat cover as in claim 1, wherein the toilet seat cover is made of corrugated cardboard, or like material.

8. A toilet seat cover as in claim 7 where in the toilet seat cover is scored to create the needed folds to provide for assembly.

9. A toilet seat cover as in claim 1, wherein the toilet seat cover can be folded horizontally along score 36 and vertically along score 38.

10. A toilet seat cover as in claim 9, wherein the toilet seat cover can be folded into dimensions 40 of about four inches to about eight inches by about five inches to about nine inches.

11. A toilet seat cover as in claim 10, wherein the toilet seat cover can be folded into dimensions 40 of about six and one-half inches wide by about seven and three-quarters inches long.

12. A toilet seat cover as in claim 1, wherein the dimensions when laid out flat are about eleven inches to about fifteen inches wide by about thirteen inches to about eighteen inches long.

13. A toilet seat cover as in claim 12, wherein the dimensions when laid out flat are about thirteen inches wide by about fifteen and one-half inches long.

14. A toilet seat cover as in claim 1, wherein the dimensions when assembled are about nine inches wide to about thirteen inches long by about nine inches wide to about thirteen inches long.

15. A toilet seat cover as in claim 14, wherein the dimensions when assembled are about eleven inches wide by about eleven inches long.

* * * * *

UNITED STATES PATENT AND TRADEMARK OFFICE

CERTIFICATE OF CORRECTION

PATENT NO. : 6,473,911 B2
DATED : November 5, 2002
INVENTOR(S) : David G. Weiss

It is certified that error appears in the above-identified patent and that said Letters Patent is hereby corrected as shown below:

Column 1,
Lines 30, 52 and 57, delete “nap-sack” and insert therefor -- knapsack --.

Column 2,
Line 4, delete “the that seat” and insert therefor -- the seat that --.

Column 3,
Line 13, delete “provides”.
Line 17, insert -- , -- after “a standard toilet seat”.
Line 17, insert -- cover -- after “the toilet seat”.
Line 42, delete “in” after “inches”.
Line 42, insert -- by -- after “wide”.

Column 4,
Line 47, insert “wide” after “eight inches”.
Line 48, insert -- long -- after “inches”.
Line 61, delete “long” and insert therefor -- wide --.
Line 61, delete “wide” and insert therefor -- long --.

Signed and Sealed this

Sixth Day of July, 2004

JON W. DUDAS
*Acting Director of the United States Patent and Trademark Office*